US007573204B2

(12) United States Patent
Rouaud et al.

(10) Patent No.: US 7,573,204 B2
(45) Date of Patent: Aug. 11, 2009

(54) STANDBY LIGHTING FOR LAMP BALLASTS

(75) Inventors: Didier Rouaud, Roanoke, VA (US); Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/648,196

(22) Filed: Dec. 29, 2006

(65) Prior Publication Data

US 2008/0157679 A1 Jul. 3, 2008

(51) Int. Cl.
*H05B 37/00* (2006.01)

(52) U.S. Cl. ..... 315/224; 315/90; 315/92

(58) Field of Classification Search ..... 315/224, 315/209 R, 88, 89, 90, 92
See application file for complete search history.

(56) References Cited

U.S. PATENT DOCUMENTS 6,072,286 A * 6/2000 Sears ..... 315/313
6,392,365 B1 5/2002 Zhou et al.
6,417,631 B1 7/2002 Chen et al.
6,459,214 B1 10/2002 Chen et al.
6,677,718 B2 1/2004 Chen et al.
6,841,941 B2 1/2005 Kim et al.
6,867,553 B2 3/2005 Nerone et al.
6,936,970 B2 * 8/2005 Chen et al. ..... 315/105
6,952,085 B2 10/2005 Nerone

* cited by examiner

*Primary Examiner*—David Hung Vu
(74) *Attorney, Agent, or Firm*—Fay Sharpe LLP

(57) ABSTRACT

For safety reasons, industrial lighting fixtures are required to have backup lighting systems so that if the primary lights should fail, there will still be enough light to ensure safe maneuvering. Typically these backup lighting systems have their own power or drive source. The present application contemplates a lighting ballast circuit that is able to power a primary high intensity discharge (HID) lamp and is also able to power an auxiliary lamp in the event of temporary or permanent failure of the HID lamp.

13 Claims, 5 Drawing Sheets

STANDBY LIGHTING FOR LAMP BALLASTS

BACKGROUND OF THE INVENTION

The present application is directed to the lighting arts. Typically, high frequency ballast inverter circuits provide power for operating a lamp, and the present application is directed to one of these ballast circuits. More particularly, the present application is directed to a ballast circuit that has the capability to power both a primary and a secondary, backup lamp, and will be described with particular reference thereto.

Typically, in an industrial lighting setting, it is often desirable to have a backup light source available should primary lights fail. Sometimes, in certain settings, it is even required to have automatic backup lighting. Many industrial lighting settings use high intensity discharge (HID) lamps because of their long life, high lumen output, and relative reliability. Yet even the best of light sources will fail from time to time. HID lamps in particular will "drop out" from time to time, meaning that they temporarily stop producing light, but are not dead, or permanently spent.

After lamp drop out, or if power is interrupted to the HID lamp, the lamp cannot be restarted until the lamp cools down. This can take up to twenty minutes, and during that time, the area in which the lamp is fixed will be without light. Temporary lighting is desirable, and often required where failure of primary light sources could present dangerous conditions. Typically, these temporary, backup light sources were powered by their own dedicated drive circuits. It has been typical that these auxiliary drive sources tap the ballasting inductor to provide a 120 V signal to the auxiliary lamp. This means that added space is required in an often already space lacking environment to house the backup drive circuits, and their associated power sources.

When an HID lamp drops out, the voltage inverter of the ballast typically does not simply stop oscillating. The unlit lamp acts essentially as an open circuit as far as the ballast is concerned, but a small amount of current still completes the circuit. Thus the lamp can be re-struck and again ramp up to its steady state operation. In the meantime however, a completely different circuit powers the auxiliary lamp while the primary lamp relights.

The present application presents a new and improved HID ballast inverter circuit that overcomes the above referenced problems and others.

BRIEF DESCRIPTION OF THE INVENTION

In accordance with one aspect of the present disclosure, a lighting ballast is disclosed. The ballast includes a first inverter switch for providing power to a primary lamp during a first half-cycle of an alternating current lamp drive signal, and a second inverter switch for providing power to the primary lamp during a second half-cycle of the lamp drive signal. A high voltage multiplier portion boosts a signal applied to the primary lamp during a startup phase. A clamping portion clamps voltages within the ballast to levels that the lamp can tolerate. A resonant portion determines an operating resonant frequency of the ballast. An integrated auxiliary lamp power portion providing power to an auxiliary lamp if the primary lamp fails.

DETAILED DESCRIPTION OF THE INVENTION

Figure 1:
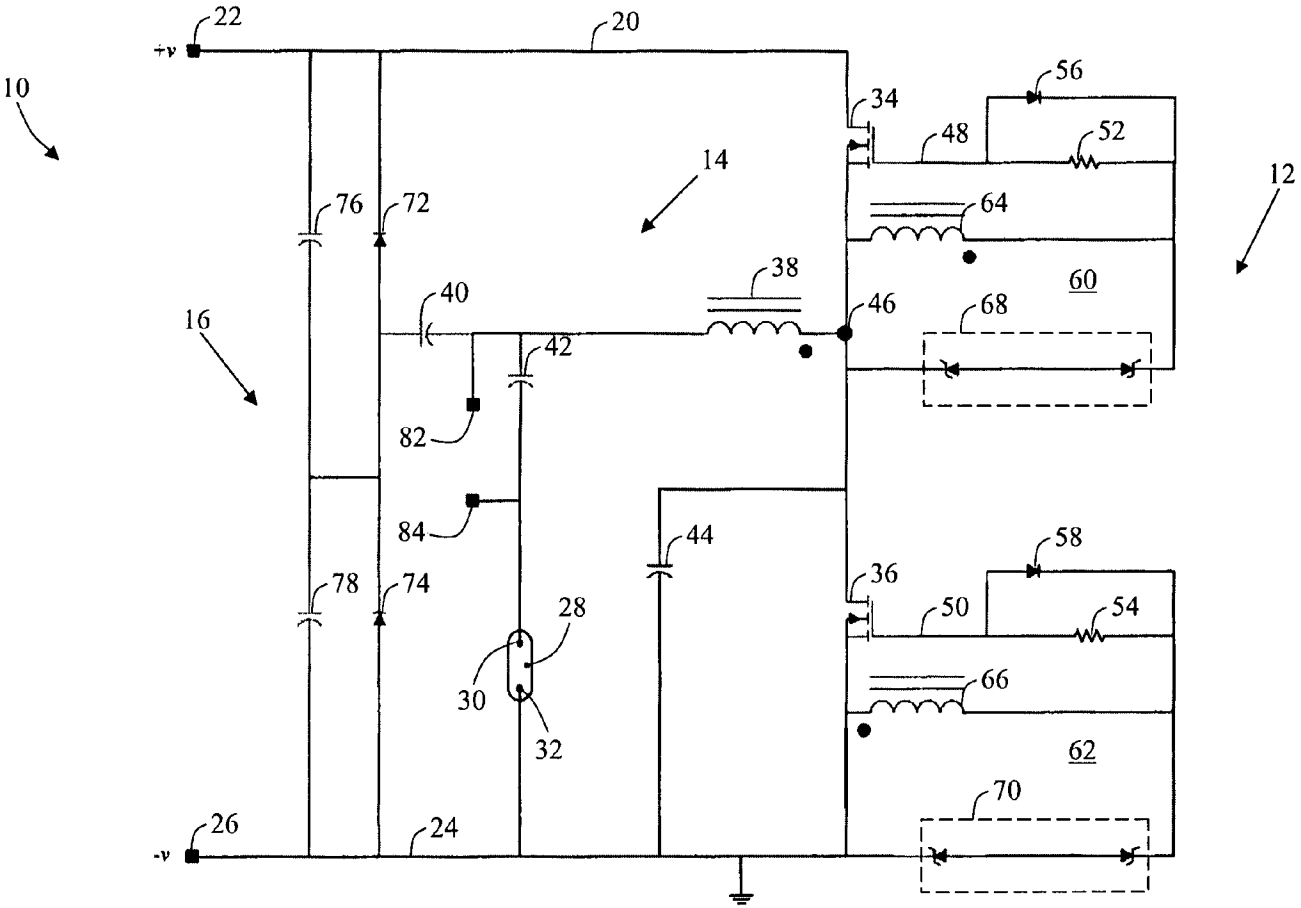
FIG. 1 is a depiction of a typical ballast inverter circuit.

With reference to FIG. 1, a ballast circuit 10 includes an inverter circuit 12, a resonant circuit 14, and a clamping circuit 16. A DC voltage is supplied to the inverter 12 via a voltage conductor 20 running from a positive voltage terminal 22 and a common conductor 24 connected to a ground or common terminal 26. A lamp 28 is powered via lamp connectors 30, 32. The lamp 28 can be any lamp that requires an operating ballast. The lamp in the illustrated embodiment is a high intensity discharge (HID) lamp.

The inverter 12 includes switches 34 and 36 such as MOSFETs, serially connected between conductors 20 and 24, to excite the resonant circuit 14. Other switches, such as IGBTs, or BJTs could also be used and are certainly contemplated. Typically, the resonant circuit 14 includes a resonant inductor 38 and a resonant capacitor network 40, 76, 78, and 42 for setting the frequency of the resonant operation. The capacitor 42 also acts as a DC blocking capacitor, which prevents excessive DC current from flowing through the lamp 28. A snubber capacitor 44 allows the inverter 12 to operate with zero voltage switching where the switches 34 and 36 turn ON and OFF when their corresponding drain-source voltages are zero.

The switches 34 and 36 cooperate to provide a square wave at a node 46 for exciting the resonant circuit 14. Gate lines, i.e., control lines 48 and 50, running from the switches 34 and 36, respectively, each include a resistance, 52 and 54, respectively. Diodes 56 and 58 are connected in parallel to the resistances 52 and 54, respectively, making the turn-off time of the switches 34 and 36 faster than the turn-on time. Achieving unequal turn-off and turn-on times provides a time when the switches 34 and 36 are simultaneously in the non-conducting states to allow the voltage at node 46 to transition from one voltage state to another voltage state by a use of residual energy stored in the inductor 38.

Gate drive circuitry, generally designated 60 and 62, includes inductors 64 and 66, which are both secondary transformer windings, each mutually coupled to primary winding 38. The gate drive circuitry 60, 62 is used to control the operation of respective switches 34 and 36. More particularly, the gate drive circuitry 60, 62 maintains the switch 34 ON for a first half of a cycle and maintains the switch 36 ON for the second half of the cycle. The square wave is generated at node 46 and is used to excite the resonant circuit 14. Bi-directional voltage clamps 68, 70 are connected in parallel to inductors 64 and 66, respectively. Each clamp 68, 70 includes a pair of back-to-back Zener diodes. The clamps 68, 70 act to clamp positive and negative excursions of gate-to-source voltage to respective limits determined by the voltage ratings of the back-to-back Zener diodes.

The output voltage of the inverter 12 is clamped by diodes 72 and 74 connected in series, which are a part of the clamping circuit 16. The clamping circuit 16 limits the high voltage generated to start the lamp 28. The clamping circuit 16 further includes capacitors 76 and 78, which are essentially connected in series to each other, but are effectively in parallel due to the low impedance of the DC bus. Each clamping diode 72, 74 is connected across an associated capacitor 76, 78. Prior to the lamp 28 starting, the lamp's circuit is essentially open, since an impedance of the lamp 28 is seen as a very high impedance. A high voltage across capacitor 42 is generated by a multiplier 80 (depicted in FIG. 2) connected between nodes 82 and 84. The resonant circuit 14, which is further composed of capacitors 40, 42, 76, 78 and inductor 38, is driven near its resonant frequency. As the output voltage on node 84 increases, the diodes 72 and 74 begin to clamp, preventing the voltage across capacitors 76 and 78 from changing sign and limiting the output voltage to the value that does not cause overheating of the inverter 12 components. When the diodes 72, 74 are clamping capacitors 76 and 78, the resonant circuit 14 becomes composed of the capacitor 40 and the inductor 38. Therefore, the resonance is achieved when the diodes 72 and 74 are not conducting.

Figure 2:
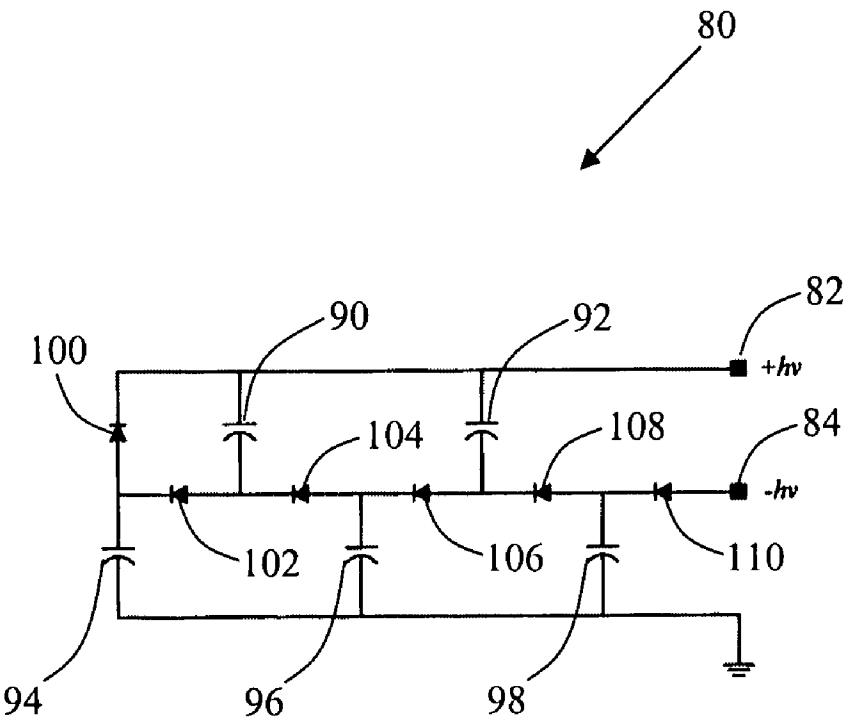
FIG. 2 is a high voltage circuit portion included in the ballast to ignite a primary HID lamp.

With continuing reference to FIG. 2 and FIG. 1, the multiplier circuit 80 boosts the voltage limited by the clamping circuit 16. The multiplier 80 is connected across the capacitor 42, achieving a starting voltage by multiplying the inverter 12 output. At the beginning of the operation, inverter 12 supplies voltage to the nodes 82 and 84. Capacitors 90, 92, 94, 96, and 98 cooperate with diodes 100, 102, 104, 106, 108, and 110 to accumulate charge for one half of a cycle, (e.g., a positive half-cycle) while during the other half-cycle, (e.g., the negative half-cycle) the charge is discharged into capacitor 42 through node 84. Typically, when the inverter 12 voltage is 500 V peak to peak, the voltage across nodes 82 to 84 rises to about 2 kV DC. The multiplier 80 is a low DC bias charge pump multiplier. During steady-state operation, the multiplier 80 applies only a small DC bias (about 0.25 Volts) to the lamp 28 which does not affect the lamp's operation or life.

Figure 3:
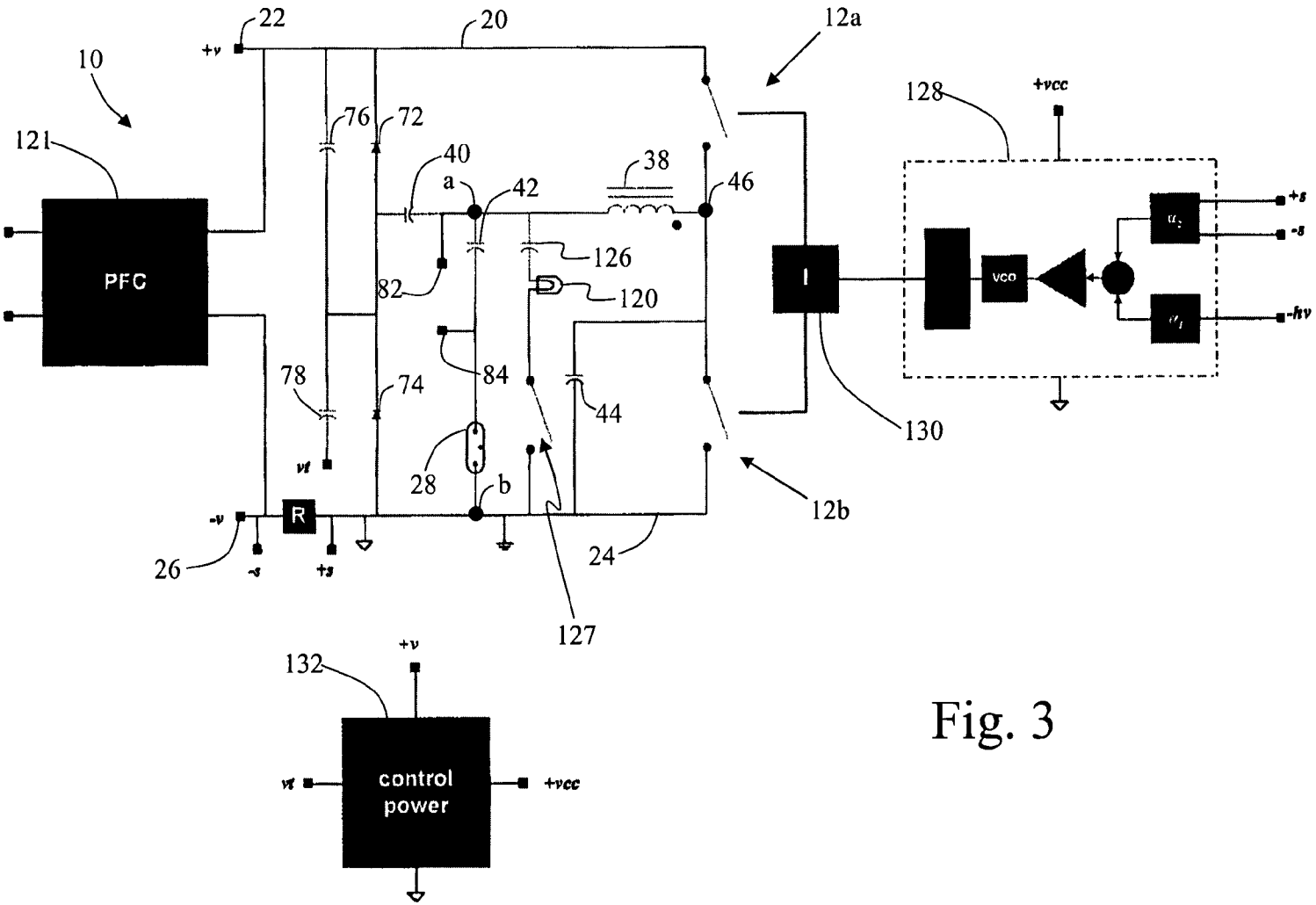
FIG. 3 is a depiction of a ballast circuit with an auxiliary light power portion.

For a variety of reasons, sometimes, during steady state operation of the ballast 10, the lamp 28 will drop out, that is, temporarily extinguish. In typical lighting applications, backup lights are provided with separate control circuitry and/or power sources. With reference to FIG. 3, an auxiliary lamp 120 is provided in the ballast 10. FIG. 3 depicts the ballast 10 of FIG. 1, with the inverter 12 represented by simple switches 12*a* and 12*b*, and with control and power circuitry added. Remaining like components are indicated with like reference numerals. Standard power factor correction circuitry 121 regulates an input from a power source (not shown) such as a 200-227 Volt line signal to the ballast.

The auxiliary lamp 120 in the illustrated embodiment is a 150 W, 120 V quartz lamp, but other lamps are also contemplated. The lamp 120 could also be a compact fluorescent lamp (CFL). In a CFL embodiment, the ballast 10 may include an extra capacitor to boost the voltage to start up the CFL. In other embodiments, the auxiliary lamp 120 could be an incandescent lamp, a halogen lamp, or other known lamp. With some additional rectification, the lamp 120 could even be a series of LEDs. The nominal light output of the auxiliary lamp can be 10% of the HID lamp's 28 output. Industry standards require that the backup lighting have at least approximately 1% of the lumen output of the primary light. Thus, in an industrial lighting setting, an auxiliary lamp that is about 10% as bright as the primary lamp can be included in one of every ten fixtures, yielding the net 1% of standard lumen output.

Figure 4:
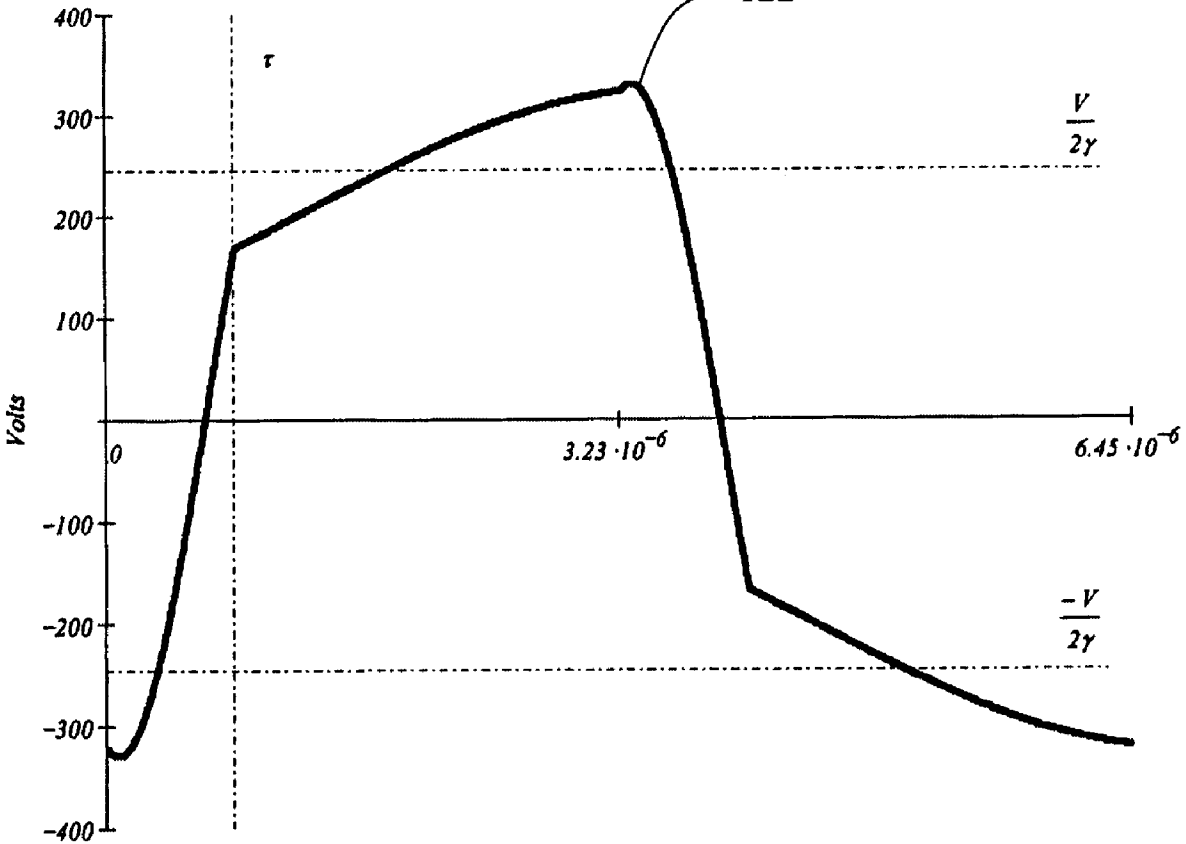
FIG. 4 is a depiction of an open circuit voltage present in the ballast.
Figure 5:
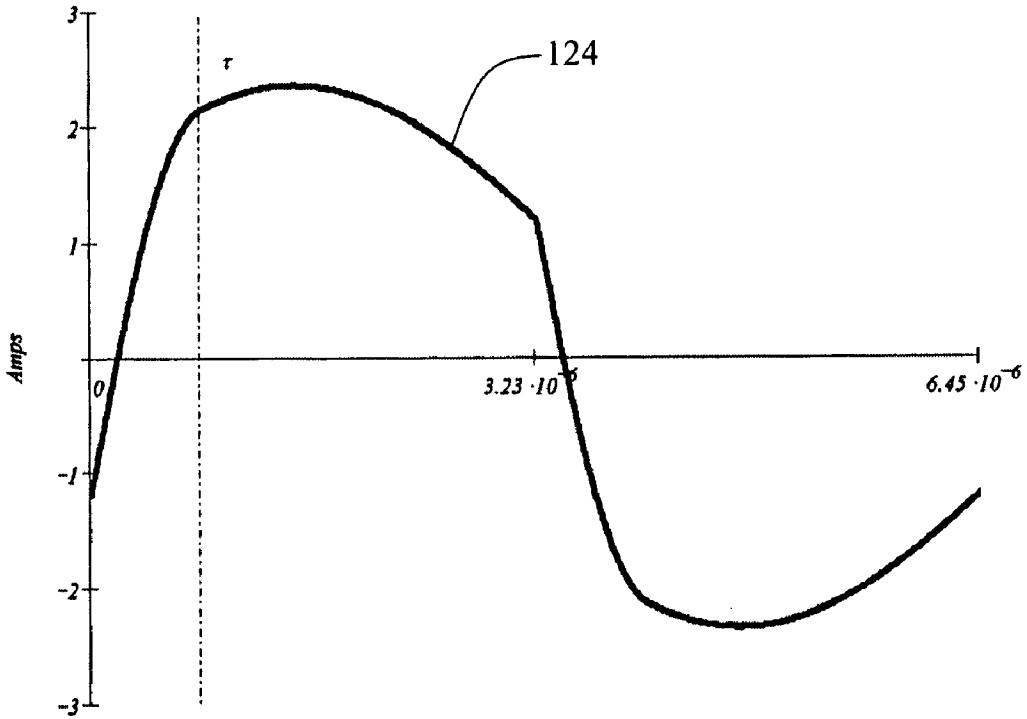
FIG. 5 is a depiction of an inductor current under open circuit conditions.

The inverter 12, before lamp ignition, is operating to supply the multiplier 80 with charge for breaking down the lamp 28. In this instance, and in other instances when the lamp is not lit (e.g., following a lamp drop out) the inverter 12 still oscillates with a low quiescent power. With reference to FIG. 4, the waveform 122 represents the AC component of the voltage seen at the node a connecting capacitor 40 and inductor 38 when the lamp 28 is not lit. In FIG. 5, the waveform 124 depicts the current flowing through the inductor 38 when the lamp 28 is not lit. Apropos, this low quiescent voltage is used to power the auxiliary lamp 120, while the HID lamp 28 is cooling down. The auxiliary lamp 120 and capacitor 126 form an additional output portion that is in parallel with the HID lamp 28 so that the auxiliary lamp 120 can be powered by the same signal that is being boosted by the multiplier 80 to re-strike the lamp 28.

With continuing attention to FIG. 3, auxiliary lamp 120 is connected in series with the capacitor 126. The nominal value of the capacitor 126 depends on the auxiliary lamp 126 and the voltage applied across the lamps 28, 120, $V_{ab}$. The impedance of the auxiliary lamp 120 is known and the desired operating voltage is known. In one embodiment, the auxiliary lamp 120 is a 150 Watt, 120 Volt quartz lamp. Thus, the determination of the value of capacitor 126 includes those factors. The capacitor 126 also limits the current through the auxiliary lamp 120. The capacitor 126 can be selected to run the auxiliary lamp at a reduced voltage, thus extending the life of the auxiliary lamp. Since the auxiliary lamp 120 may burn out in applications where the power equipment is less reliable, increasing the life of the auxiliary lamp can be of great benefit to a consumer.

Once the HID lamp 28 is re-ignited, the auxiliary lamp 120 does not have to extinguish immediately. In one embodiment, the ballast 10 senses the power across the HID lamp 28 and cuts out the auxiliary lamp 120 by opening switch 127 when the HID lamp re-achieves about 30%-70% of its potential lumen output. In the illustrated embodiment, the ballast 10 can cut out the auxiliary lamp 120 when the HID lamp 28 reaches approximately 50% of its potential lumen output. As shown in FIG. 3, a circuit power monitor 128 receives a current measurement from a current sense resistor R that measures the current flowing through the DC bus which is proportional to the total output power of the inverter, including the HID lamp 28 and the auxiliary lamp 120. Box 130 is an interface circuit that applies the buffered vco signal to the gates of the switches 34, 36.

Power for the monitor 128 is provided by the ballast 10 via power control circuitry 132. From the detected current, and the DC bus voltage, the power sensor 128 can calculate the average power being applied to the lamp 28. As the lamp 28 ramps back up to steady state operation, the current provided increases. That is, current is proportional to power. Once the power sensor 128 senses that the HID lamp 28 is running at about 50% power, (i.e. 50% lumen output) then the auxiliary lamp 120 switches off. The switch 127 that turns off the auxiliary lamp could be a BJT, MOSFET or IGBT. The switch 127 is driven by a comparator that senses when the bus power is less than a predetermined level. This would indicate that the HID lamp has extinguished. At that point, the comparator turns on the switch. When the power rises above a predetermined level, the comparator turns off the switch.

The signal that drives the switch 127 can be designed to turn off the auxiliary lamp 120 at any desired level. One possibility is to have the total power delivered to the HID lamp 28 and the auxiliary lamp 120 limited to the nominal power setting of the inverter. For example, the auxiliary lamp 120 could be switched off when the bus power reaches its nominal value. If the auxiliary lamp 120 is a 150 W halogen lamp and the HID lamp 28 is a 400 W lamp, this would mean that the switch 127 would extinguish the auxiliary lamp 120 when the HID lamp reaches 250 Watts.

Generally, the ballast is very cost effective. As has been shown, the auxiliary lamp 120 accommodating circuitry can be added to present ballast arrangements with very little modification. Thus, it can be included in every ballast produced, and not limited to the 10% of ballasts, as mentioned above.

While it is to be understood the described circuit may be implemented using a variety of components with different component values, provided below is a listing for one particular embodiment when the components have the following values:

| Reference Character | Component |
|---|---|
| Switch 34 | 20NMD50 |
| Switch 36 | 20NMD50 |
| Inductor 38 | 90 μH |
| Capacitor 40 | 22 nF, 630 V |
| Capacitor 42 | 33 nF, 2 kV |
| Capacitor 44 | 680 pF, 500 V |
| Resistor 52 | 100 Ω |
| Resistor 54 | 100 Ω |
| Diode 56 | 1N4148 |
| Diode 58 | 1N4148 |
| Inductor 64 | 1 mH |
| Inductor 66 | 1 mH |
| Diode Clamp 68 | 1N4739 |
| Diode Clamp 70 | 1N4739 |
| Diode 72 | 8ETH06S |
| Diode 74 | 8ETH06S |
| Capacitor 76 | 1 nF, 500 V |
| Capacitor 78 | 1 nF, 500 V |
| Capacitors 90, 92, 94, 96, 98 | 150 pF, 2 kV |
| Diodes 100, 102, 104, 106, 108, 110 | 1 kV |
| Switch 127 | FCD7N60 |

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lighting ballast comprising:

a plurality of bi-directional voltage clamps;

a first inverter switch for providing power to a primary lamp during a first half-cycle of an alternating current lamp drive signal;

a second inverter switch for providing power to the primary lamp during a second half-cycle of the lamp drive signal;

a high voltage multiplier portion for boosting a signal applied to the primary lamp during a startup phase;

a clamping portion for clamping voltages within the ballast to levels that the lamp can tolerate;

a resonant portion that determines operating resonant frequency of the ballast attached to at least one inverter switch; and, an integrated auxiliary lamp power portion for providing power to an auxiliary lamp if the primary lamp extinguishes.

2. The lighting ballast as set forth in claim 1, wherein the ballast includes a power sensor that senses the average power being applied to the primary lamp and detects when the primary lamp extinguishes, thereby enabling the auxiliary lamp.

3. The lighting ballast as set forth in claim 2, wherein the power sensor detects when the primary lamp re-ignites, and when to switch the auxiliary lamp off after the primary lamp reaches a predetermined lumen output.

4. The lighting ballast as set forth in claim 3, further including:

an auxiliary lamp control switch that switches the auxiliary lamp off when the power sensor senses that the primary lamp has reached between 30% and 70% of its steady state operating lumen output.

5. The lighting ballast as set forth in claim 3, further including:

an auxiliary lamp control switch that switches the auxiliary lamp off when the power sensor senses that the primary lamp has reached between 50% of its steady state operating lumen output.

6. The lighting ballast as set forth in claim 1, wherein the integrated auxiliary lamp power portion is arranged in parallel with the primary lamp.

7. The lighting ballast as set forth in claim 6, wherein the high voltage multiplier portion and the auxiliary lamp power portion are powered by the same signal from the first and second inverter switches.

8. The lighting ballast as set forth in claim 1, wherein the auxiliary lamp emits 10% of the steady state lumen output of the primary lamp.

9. The lighting ballast as set forth in claim 1, wherein the auxiliary lamp is a quartz auxiliary lamp.

10. The lighting ballast as set forth in claim 1, wherein the auxiliary lamp is an incandescent auxiliary lamp.

11. The lighting ballast as set forth in claim 1, wherein the auxiliary lamp is a compact fluorescent auxiliary lamp.

12. The lighting ballast as set forth in claim 1, wherein the primary lamp is a high intensity discharge (HID) lamp.

13. A lighting fixture comprising:

a first, primary lamp for performing a primary lighting function;

a second, auxiliary lamp for performing an auxiliary lighting function in the event of failure of the primary lamp; and, a ballast inverter circuit comprised of two diodes arranged back to back and in parallel with an inductor, a resistor, and a diode that provides power to the primary lamp, and provides power to the auxiliary lamp when the primary lamp fails.

* * * * *